US008690029B2

(12) United States Patent
Murdoch et al.

(10) Patent No.: US 8,690,029 B2
(45) Date of Patent: Apr. 8, 2014

(54) BACKPACK AND WAIST BAG CARRYING SYSTEM

(75) Inventors: Douglas Harland Murdoch, Santa Rosa, CA (US); Michael Sturm, Redding, CA (US)

(73) Assignee: Think Tank Photo, Inc., Santa Rosa, CA (US)

( * ) Notice: Subject to any disclaimer, the term of this patent is extended or adjusted under 35 U.S.C. 154(b) by 850 days.

(21) Appl. No.: 11/667,582

(22) PCT Filed: Apr. 28, 2006

(86) PCT No.: PCT/US2006/016708

§ 371 (c)(1),
(2), (4) Date: Nov. 5, 2007

(87) PCT Pub. No.: WO2006/119230

PCT Pub. Date: Nov. 9, 2006

(65) Prior Publication Data

US 2008/0302839 A1 Dec. 11, 2008

Related U.S. Application Data

(60) Provisional application No. 60/676,257, filed on Apr. 30, 2005.

(51) Int. Cl.
*A45F 3/04* (2006.01)

(52) U.S. Cl.
USPC ..... 224/153; 224/581

(58) Field of Classification Search
USPC ..... 224/581–583, 628, 630, 631, 646, 647, 224/650, 652, 672, 676, 681–683, 224/901–901.8, 195, 633, 634, 637; 248/205.2
See application file for complete search history.

(56) References Cited

U.S. PATENT DOCUMENTS 5,228,609 A * 7/1993 Gregory ..... 224/617
5,487,498 A * 1/1996 Gleason ..... 224/662

(Continued)

FOREIGN PATENT DOCUMENTS

EP 1 876 919 B1 3/2010
JP 60-172527 11/1985
JP 2003-311006 3/2005

OTHER PUBLICATIONS

Response to Rule 161 and 162 EPC communication sent to EPO on Jan. 20, 2008 and received by the EPO on Jan. 31, 2008.

(Continued)

*Primary Examiner* — Adam Waggenspack
(74) *Attorney, Agent, or Firm* — R. Dabney Eastham

(57) ABSTRACT

The invention provides a backpack (10) and cooperating waist bag (100) carrying system. In one embodiment the backpack has a lower or lumbar region below the bag portion of the backpack that releasably contains the receiver of the waist bag when the belt of the waist bag is secured around the bearer's waist and the backpack is worn on the bearer's back. The receiver of the waist bag can be moved without having to take off the backpack so that the receiver of the waist bag is disposed to the bearer's front and the bearer can gain access to the contents of the receiver. The bearer can then move the receiver back to the lower region of the backpack and the combination of the backpack and the waist bag then will appear to be a normal backpack with a waist belt. While moving the receiver, the waist bag remains operatively connected to the backpack.

24 Claims, 16 Drawing Sheets

(56) References Cited

U.S. PATENT DOCUMENTS

| | | | | |
|---|---|---|---|---|
| 5,673,836 | A * | 10/1997 | Bush | 224/576 |
| 5,934,527 | A | 8/1999 | Von Neumann | |
| 5,964,384 | A | 10/1999 | Young | |
| 6,098,857 | A * | 8/2000 | Le Gal | 224/161 |
| 6,189,750 | B1 * | 2/2001 | Von Neumann | 224/153 |
| 6,619,519 | B1 * | 9/2003 | Nix et al. | 224/153 |
| 6,722,543 | B1 * | 4/2004 | Fitzgerald et al. | 224/583 |
| 2006/0097019 | A1 * | 5/2006 | Just-Buddy | 224/148.7 |

OTHER PUBLICATIONS

Invitation from the examining division pursuant to Article 94(3) and Rule 71(1) EPC, dated Dec. 12, 2008.
Reply to the invitation pursuant to Article 94(3) and Rule 71(1) EPC, sent on May 12, 2009 and received by the EPO on Jun. 4, 2009.
Communication of intent to grant pursuant to Rule 71(3) EPC, dated Jul. 17, 2009.
Decision to grant pursuant to Rule 97(1) EPC, dated Feb. 11, 2010.

* cited by examiner

BACKPACK AND WAIST BAG CARRYING SYSTEM

CROSS-REFERENCE TO RELATED APPLICATIONS

This application claims the benefit of U.S. provisional patent application Ser. No. 60/676,257, filed on Apr. 30, 2005 for a "Backpack and Rotating Waist Bag Carrying System," by Douglas Harland Murdoch and Michael Sturm, the disclosure of which is incorporated herein by reference.

STATEMENT REGARDING FEDERALLY SPONSORED RESEARCH OR DEVELOPMENT

Not applicable.

FIELD

The field of the disclosure is that of carriers for articles to be borne by animate bearers, and, in particular, that of backpacks.

BACKGROUND

A sports or outdoors photographer often will wear a backpack in order to carry his or her photographic equipment as well as her other gear. Equipment that is stored in the backpack is not readily available, however, because the photographer will have to remove the backpack from its normal position on his or her back or posterior side and shift the backpack to her front or anterior side in order to gain access to a compartment in the backpack. A photographic opportunity often is fleeting and can be missed due to the time needed to obtain a camera from the backpack. Alternatively, the photographer simply may not want to stop and remove the camera from the backpack due to the effort required.

A photographer wearing a backpack may choose to keep his or her camera more available for ready use by hanging it by a strap from his or her neck. This can be an awkward way to carry a camera for any length of time and exposes the camera to rain, collision, abrasion, dust, and theft. Alternatively, the camera could be contained in a case suspended from a shoulder strap, the sternum strap or the waist belt of the backpack or carried in a pocket of a garment worn by the photographer, such as a vest. These methods of carrying a camera will be awkward or impossible if the camera is large, such as a modern single lens reflex digital camera with a detachable lens. In addition, the camera will not be as protected as it would be in the backpack. Furthermore, other, perhaps untrustworthy, persons will be able to observe that the photographer is carrying a large and expensive camera.

Alternatively, the photographer may carry his or her camera in a waist bag (also known as a "belt pack," "lumbar pack," "lumbar bag" or "waist pack"). A waist bag provides some protection for the camera from rain, collision, abrasion, dust, and theft as well as being a comfortable means for carrying a large camera. A waist bag also is desirable because it can be rotated from a comfortable position at the photographer's back to his or her front where the contents, such as a camera, will be readily available. Users become uncomfortable when wearing a waist bag on the front of the body for an extended period of time and will want to return the waist bag to the more comfortable position on the back of the body.

However, wearing a backpack is incompatible with wearing a waist bag because the waist belt of the backpack, if it has one, will tend to interfere with the use of the waist bag. The backpack will also prevent it from being rotated to the more comfortable position on the photographer's back or posterior side because the backpack will be in the way.

Accordingly, photographers who need ready access to a camera in combination with a carrying system that will provide protection for the camera from rain, collision, abrasion, dust, and theft as well as having a comfortable means for carrying a large camera will tend to choose a waist bag but at the cost of not being able to simultaneously carry a backpack. This is a difficult choice for photographers in the field, particularly for those who must carry large amounts of photographic gear such as additional lenses, camera bodies, and a monopod or tripod, and possibly large amounts of non-photographic gear such as food, water, sunscreen, clothing, and other essentials.

Persons who are not necessarily photographers, such as backpackers, climbers, hikers, birdwatchers, and so forth, would find that a carrying system combining the advantages of both backpacks and waist bags will provide ready access to needed gear or other items while providing protection of the gear and other items from rain, collision, abrasion, dust, and theft, in addition to having the greater carrying capacity of a backpack.

Other designers have attempted to provide carrying systems combining the advantages of both backpacks and waist bags. A number of manufacturers have provided backpacks with a pocket, such as the top flap pocket, that can be detached from the backpack and either has a built-in belt or may be attached to a belt so that the pocket can be worn as a waist bag. Detaching the pocket will require the person wearing the backpack to remove the backpack from his or her back in order to reach the pocket and deploy it into its waist bag configuration. As noted above, however, the backpack and the waist bag will interfere with each other if the person tries to wear both at the same time.

An alternative approach is to provide a waist bag with a concealable extension and shoulder straps attached to the extension so that the waist bag can be converted into a backpack. This system does not provide the advantages of a backpack and a waist bag at the same time: one must choose one or the other configuration.

U.S. Pat. No. 5,887,770 to Covell for a "Convertible Waist Bag, Day Backpack and Shoulder Bag" discloses a multiple use pack that may be modified into any one of one of three types of packs or bags by opening or closing a zipper. As noted in connection with the above discussion of the waist bag with a concealable extension and shoulder straps attached to the extension, the bearer must choose one configuration at a time and cannot obtain the benefits of two configurations at once. U.S. Pat. No. 5,964,384 to Young for a "Traveling Bag with Expandable Storage Volume" also provides a multiple use pack that may be modified into a waist bag, a shoulder bag (a bag intended to be carried from a single strap passing over the top of one shoulder of the bearer) or a backpack, but only one configuration at a time is permitted, as with Covell.

U.S. Pat. No. 6,672,495 B2 to Sagan for a "Bifurcated Carrier Pack for Transporting Recreational Equipment" discloses a carrier pack for equipment such as a snowboard that can be worn as a backpack or in an unusual hip-mounted position in which the shoulder straps encircle the legs. The bearer must choose one or the other configuration for wearing at one given time. As with Covell and Young, the bearer cannot obtain the benefit of a waist bag and a backpack at the same time.

U.S. Pat. No. 5,934,527 to Von Neumann for "Modular Backpack" discloses a four-bag or unit modular backpack in which the middle bag may be removed from the main bag and used by itself as a waist bag. The bag components are connected with zippers or snaps. The main bag has shoulder straps and is usable as a backpack by itself or joined with the middle bag and a lower bag. Once the main and middle bags are separated, however, the bearer may be able to wear the waist bag and the main bag at the same time because the main bag is fairly short and should not hang down the wearer's back so far as to prevent the shifting of the waist bag to the rear as long as the wearer leans forward. Von Neumann, however, does not provide a modular backpack with a readily deployable waist bag. The person wearing the Von Neumann modular backpack will have to remove the modular backpack from her back in order to unfasten the middle bag from the main bag in order to wear the middle bag as a separate waist bag, which will be necessary if he or she wishes to wear it on his or her front side. Furthermore, once the middle bag is separated from the main bag it cannot be reattached to the main bag without taking off the bags in order to operate the zippers or snaps that connect them.

Perhaps the closest example known to the inventors of a carrying system combining the advantages of both a backpack and a waist bag is the Orion AW "beltpack/backpack" sold by Lowepro. The Orion AW "beltpack/backpack" has an upper pack that is connected to a waist bag with side release buckles. The user can release the waist bag from the upper pack by unfastening the side release buckles and then rotating the waist bag to the front. The user may then rotate the waist bag back under the upper pack but will encounter difficulty in reconnecting the upper pack to the waist bag by fastening the side release buckle halves to each other. (See http://www.lowepro.com/images/downloads/orionaw.pdf; accessed 27 Apr. 2006.) Some gymnastics will be necessary. In fact, some users find this operation to be impossible due to corpulence or lack of agility.

The waist bag must be reconnected to the upper pack of the Orion AW "beltpack/backpack" in order for the waist bag component to receive some support from the shoulder straps. The users who are unable to reconnect the waist bag to the upper pack will have to take off both components in order to reconnect them. Even if the user can reconnect the waist bag and the upper pack components without removing them, the user will find that the waist bag is not positively connected to the upper pack in such a way as to prevent some independent movement or wobbling of the components with respect to each other.

Furthermore, the Orion AW "beltpack/backpack" looks like an obvious combination of a waist bag and a backpack and therefore appears to be somewhat "gimmicky." It may draw attention that may be unwelcome for a street photographer.

Accordingly a need exists for a carrying system that provides the protection and carrying capacity of a backpack but also provides a means for deploying equipment from the backpack for use by the wearer of the backpack without having to remove the backpack.

In particular, a need exists for a carrying system having a backpack that allows the bearer to immediately access desired items in the backpack without removing the backpack, and then to easily return the desired items to the backpack.

In particular and in addition, a need exists for a carrying system having a backpack that allows the bearer to immediately access desired items in the backpack without removing the backpack, and then to return the desired items to the backpack, without the bearer having to engage in gymnastics in order to accomplish these actions.

Furthermore, a need exists for a carrying system that provides the advantages of both a backpack and a waist bag.

In addition and furthermore, a need exists for a carrying system that provides the advantages of both a backpack and a waist bag that will look like a backpack when the waist bag of such a system is not deployed to the front of the bearer.

In addition and finally, a need exists for a carrying system that combines the advantages of both a backpack and a waist bag, and also permits the waist bag to be rotated back to the backpack.

SUMMARY

The invention satisfies these needs by providing a carrier system that has cooperating backpack and waist bag components that can be operated while being worn by a bearer or user so as to permit the bearer to deploy a receiver of the waist bag to the anterior side or front of the bearer and to return the receiver to a position coincident with the backpack so that the backpack and waist bag support each other as in a regular backpack with waist belt and shoulder straps.

The invention therefore provides a backpack and waist bag carrying system comprising a backpack comprising a bag portion defining a first compartment for receiving articles, the bag portion comprising a back-contacting wall, and shoulder straps for supporting the bag portion on a bearer's back; a waist belt operatively connected to the backpack below the bag portion; and a receiver supported by the waist belt, whereby the bearer may move the receiver about the bearer's waist in order to shift the receiver from below the bag portion to the front of the bearer.

In one exemplary embodiment, the carrier system of the invention provides a backpack that has a space or compartment in the lower or lumbar region of the backpack that can releasably contain the receiver of a waist bag when the belt of the waist bag is secured around the bearer's waist so that the bearer can rotate the waist bag about the bearer's waist to the anterior side of the bearer while the bearer is wearing the backpack on his or her posterior side or back.

In another exemplary embodiment, the carrier system of the invention provides a backpack and a waist belt supporting a receiver arranged so that while the bearer is wearing the backpack on his or her posterior side or back the receiver may be moved with respect to the waist belt from below the backpack to the anterior side or front of the bearer.

OBJECTS OF THE INVENTION

It is an object and advantage of the present invention to provide a carrying system that combines the advantages of a backpack and a waist bag.

Another object and advantage is to provide a carrying system that provides the protection and carrying capacity of a backpack but also provides a means for deploying equipment from the backpack for use by the wearer of the backpack without having to remove the backpack.

Another object and advantage is to provide a carrying system having a backpack that allows the bearer to immediately access desired items in the backpack without removing the backpack, and then to easily return the desired items to the backpack.

Another object and advantage is to provide a backpack with a rotating receiver of a waist bag that can be easily deployed to the bearer's front or anterior side and easily returned to the bearer's back or posterior side without having to remove the backpack.

Another object and advantage is to provide a system that is a combination of a backpack and a waist bag that fully supports the weight of the waist bag receiver when the waist bag receiver is deployed to the rear of the bearer.

Yet another object and advantage of the invention is to provide a system that is a combination of a backpack and a waist bag that firmly secures the waist bag receiver to the backpack when the waist bag receiver is deployed to the rear of the bearer so that the waist bag will not wobble and is fully controlled.

Another object and advantage is to provide a system that is a combination of a backpack and a waist bag that looks like a backpack when the waist bag receiver is deployed to the rear of the bearer.

DESCRIPTION OF THE DRAWINGS

Other objects, features, and advantages of the present invention will become more fully apparent from the following detailed description of preferred embodiments, the appended claims, and the accompanying drawings in which:

DETAILED DESCRIPTION OF PREFERRED EMBODIMENTS

Figure 1:
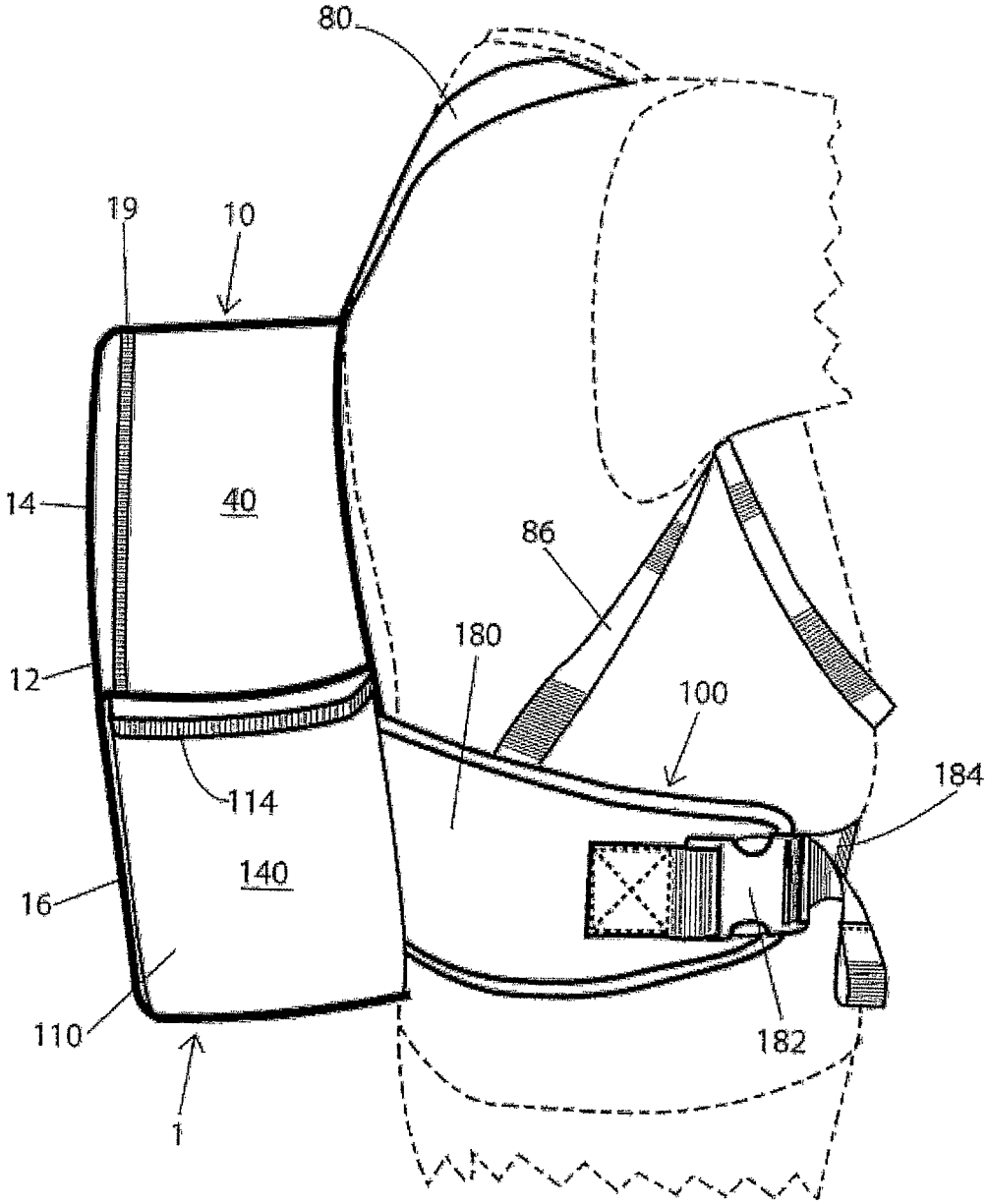
FIG. 1 is a perspective view from the right side of a preferred embodiment of a backpack with waist bag carrying system according to the invention shown being worn by a human bearer in a first configuration in which the receiver of the waist bag is deployed inside the backpack.

Referring now to the drawings, a first preferred embodiment of a backpack with waist bag carrying system according to the invention is indicated generally by reference numeral 1.

The backpack with waist bag carrying system 1 comprises two cooperating components: a backpack 10 and a waist bag 100. The backpack 10 has a bag portion 12 defining a first or upper compartment 18, and a lower open-sided compartment 95 that receives the waist bag 100, thereby providing an operative connection between the waist bag 100 and the backpack 10. The bearer may wear the combination of the backpack 10 and the waist bag 100 just as he or she would wear a normal backpack when they are in the first configuration shown in FIGS. 1, 3, and 4.

In the first configuration, the backpack 10 will support the waist bag 100 and the waist bag 100 will support the backpack 10. The backpack 10 has shoulder straps 80 and 82 that support the bag portion 12 of the backpack 10 on the back or posterior side of the bearer and, in this first configuration, the receiver 110 of the waist bag 100, by providing support from above. The waist bag 100 has a waist belt 180 encircling the waist of the bearer that will support the receiver 110 of the waist bag 100 and, in this first configuration, the bag portion 12 of the backpack 10 on the back or posterior side of the bearer, by providing support from below. Once the receiver 110 of the waist bag 100 rotates into the backpack 10, the receiver 110 in combination with the waist belt 180 can support all or part of the weight of the backpack 10. This means that the bearer can loosen the shoulder straps 80 and 82 so that the weight of the backpack 10 is supported on the waist belt 180 and is therefore supported on the hips of the bearer.

Figure 2:
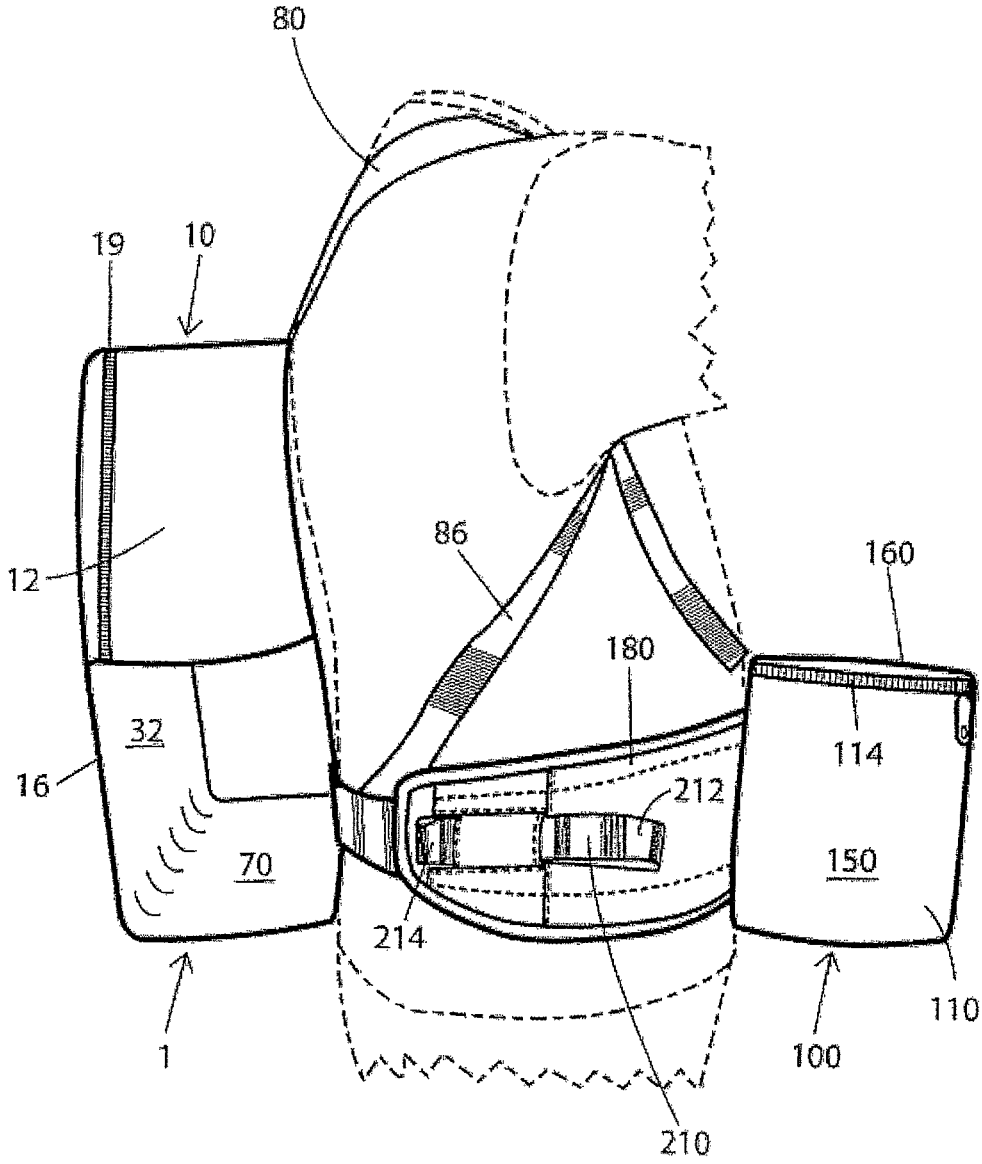
FIG. 2 is a is a perspective view from the right side of the preferred embodiment of a backpack with waist bag carrying system of FIG. 1 shown being worn by a person in a second configuration in which the receiver of the waist bag is deployed in front of or on the anterior side of the bearer.

The receiver 110 of the waist bag 100 may be withdrawn from the open-sided compartment 95 in the bag portion 12 of the backpack 10, while the backpack 10 is worn on the body of the bearer, and rotated from under the bag portion 12 (and thus the posterior or rear side of the bearer) to the anterior or front side of the bearer, as in the second configuration of the backpack 10 and the waist bag 100 shown in FIG. 2. In this configuration the bearer will have access to the contents of the receiver 110 of the waist bag 100 without having to remove the backpack 10. The waist bag 100 will remain operatively connected to the backpack 10.

Figure 3:
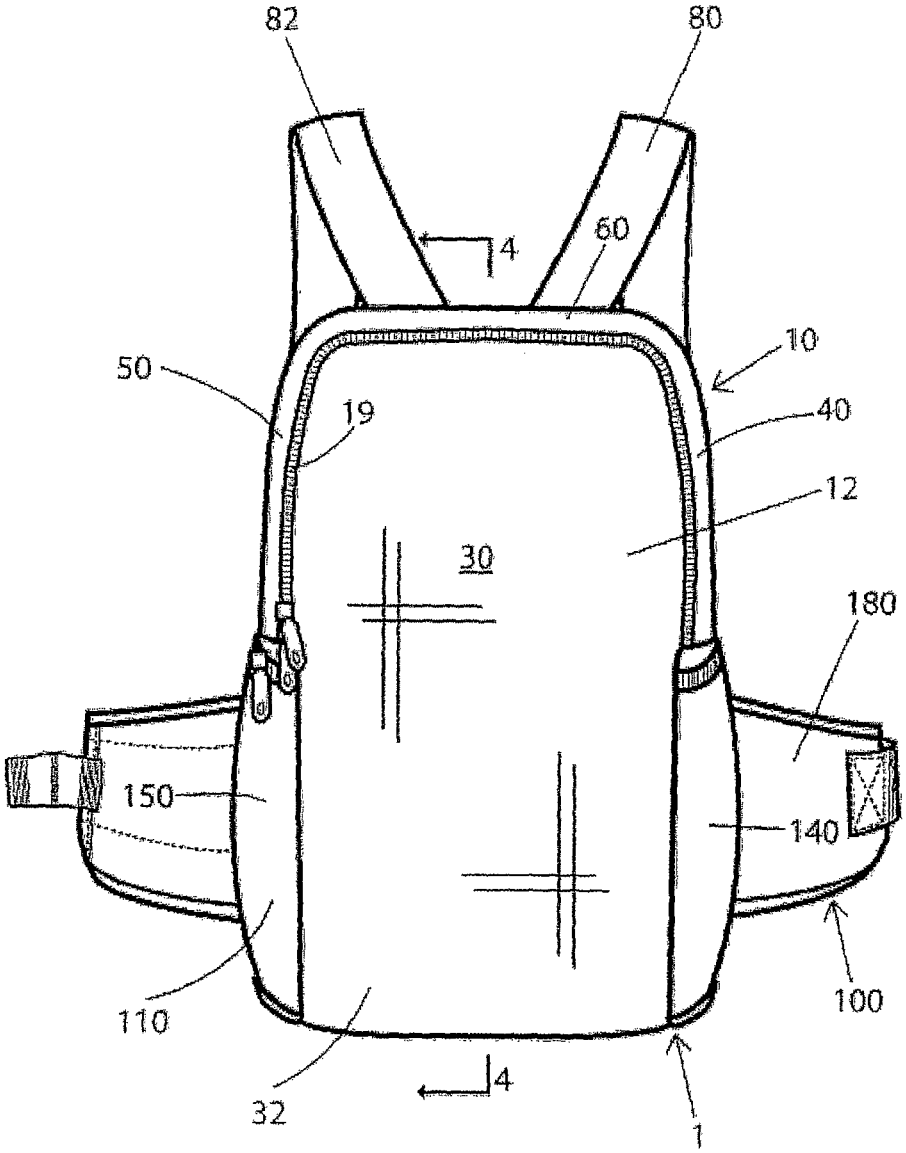
FIG. 3 is a front side view of the preferred embodiment of a backpack with waist bag carrying system of FIG. 1 in the first configuration in which the receiver of the waist bag is deployed inside the backpack.
Figure 4:
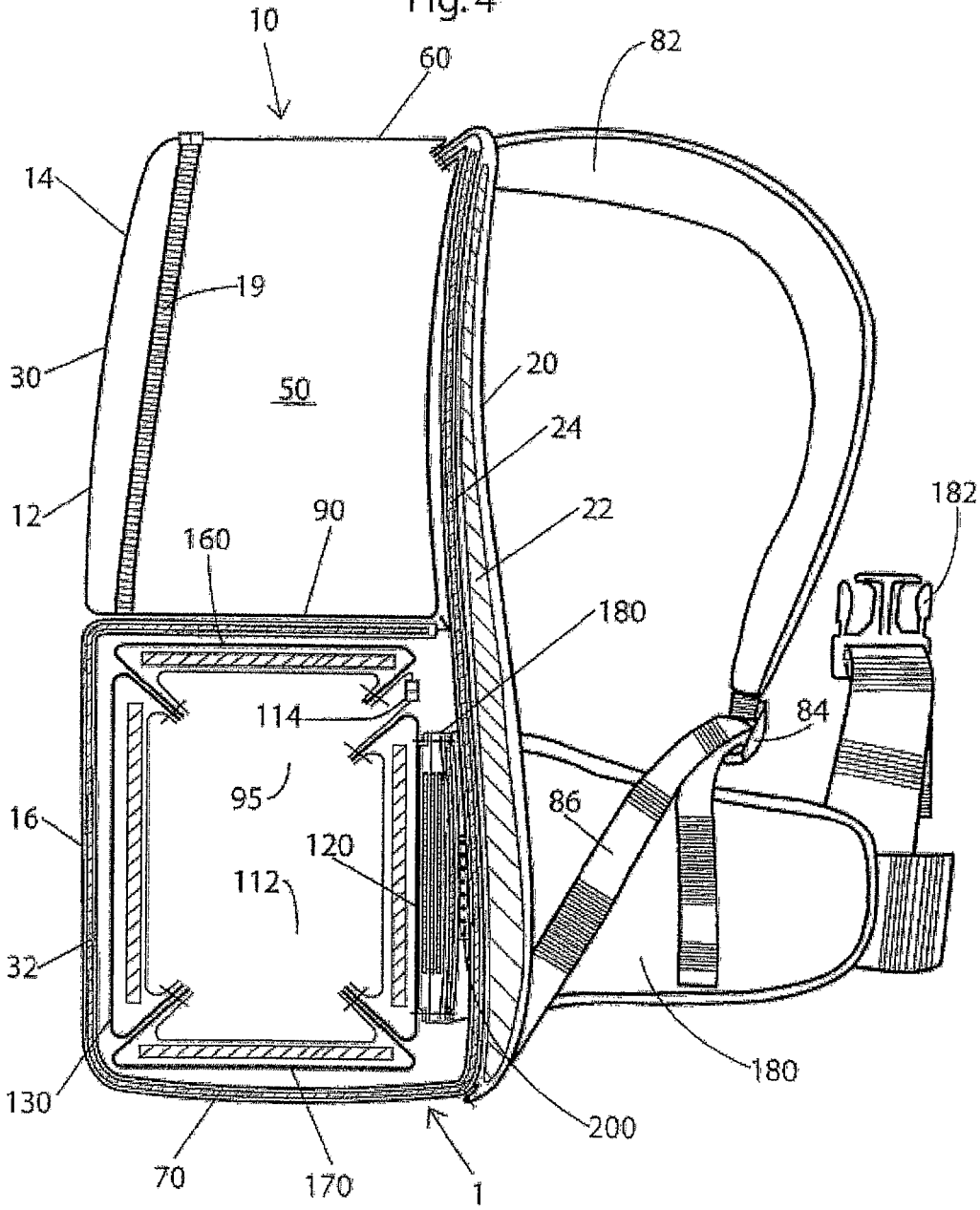
FIG. 4 is a sectional view of the backpack with waist bag carrying system of FIG. 3 taken along plane 4-4 as indicated in FIG. 3.

The bearer can shift or rotate the waist bag 100 back to the configuration shown in FIGS. 1, 3, and 4 when desired without removing either the backpack 10 or the waist bag 100. In this configuration, the backpack with waist bag carrying system 1 may be removed from the bearer and carried, such as by hand, as one unit (as in FIG. 3, in which the backpack with waist bag carrying system 1 is shown by itself and not attached to a bearer). In this respect the backpack with waist bag carrying system 1 operates and may be used like any known backpack with waist belt.

The user or bearer may wear the backpack 10 and the waist bag 100 separately, if desired.

Apart from the open-sided compartment 95, the backpack 10 shown in FIGS. 1-5 is like conventional backpacks or rucksacks in that the backpack 10 has a body contacting wall 20 and a generally opposed and parallel non-body contacting wall 30 joined by right and left side walls 40 and 50, a top wall 60, and a bottom wall 70. (In this specification, the terms right and left as used with respect to the backpack 10 and waist bag 100 refer to the bearer's right and left when the backpack 10 and the receiver 110 of the waist bag 100 are worn on the bearer's posterior side or back.) The body contacting wall 20 is also joined to the non-body contacting wall 30 by a middle wall 90 that is generally parallel to and disposed between the top wall 60 and the bottom wall 70.

The backpack 10 in the first preferred embodiment is generally divided into an upper or superior part 14 that comprises the bag portion 12 and a lower or inferior part 16. The upper part 14 is generally above the middle wall 90. The lower part 16 is that portion of the backpack 10 that is generally below the middle wall 90 and will be adjacent the lumbar portion of the bearer's spine when the backpack 10 is worn on the bearer's back.

The upper part 14 is formed by the body contacting wall 20, the non-body contacting wall 30, the right and left side walls 40 and 50, the top wall 60, and the middle wall 90. These walls together define the first or upper compartment 18. The upper compartment 18 is accessed via an opening in the top wall 60, the right side wall 40, and the left side wall 50 that is reversibly secured by a zipper 19.

The lower part 16 of the backpack 10 is comprised of the body contacting wall 20, the non-body contacting wall 30, the bottom wall 70, and the middle wall 90 that define the open-sided compartment 95. The lower part 16 is the part of the backpack 10 that is adjacent the bearer's lumbar region and waist The right and left side walls 40 and 50 do not extend lower than the middle wall 90. The open-sided compartment 95 is therefore open on the right and left of the lower portion 14 of the backpack 10.

Right and left flaccid supporting members or shoulder straps 80 and 82 are provided for supporting the backpack 10 when the backpack 10 is worn on the bearer's back. Each of the shoulder straps 80 and 82 is attached at opposed ends thereof to the backpack 10 at the top and bottom of the body contacting wall 20 and so disposed that the shoulder straps 80 and 82 will each cross over one of the bearer's shoulders when the backpack 10 is worn on the bearer's back or posterior side. The shoulder straps 80 and 82 in the currently preferred embodiment have a conventional two-part design in which an upper padded strap portion is linked to a lower unpadded strap portion 86 by a slider buckle 84.

The waist bag 100 shown in FIGS. 1-4 is like conventional waist bags in that it has a receiver 110 that has a body contacting wall 120 and a generally opposed and parallel non-body contacting wall 130 joined by right and left side walls 140 and 150, a top wall 160, and a bottom wall 170 that define an internal compartment 112. In this embodiment the body contacting wall 120 does not actually contact the body of the bearer because it is attached to a waist belt 180 that contacts the body of the bearer. It will be understood that the term "body contacting" means "closest to the body of the bearer" and "non-body contacting" means "side furthest from the body of the bearer." In the embodiment shown in the U.S. provisional patent application Ser. No. 60/676,257 that is incorporated by reference, the receiver is part of the waist belt, rather than being attached to an outside surface of the waist belt, and has a body contacting side that actually contacts the body of the bearer when the waist belt 180 is rotated as described below.

The internal compartment 112 of the receiver 110 is accessed via an opening at the juncture of the top wall 160, the body contacting wall 120, the right side wall 140, and the left side wall 150 that is reversibly secured by a zipper 114.

The receiver 110 is attached, such as by sewing, to a belt 180 having a buckle 182 that is intended to be worn about the waist of the bearer in the manner of a conventional waist belt. The bearer can move the receiver 110 of the waist bag 100 from the anterior to the posterior side of the bearer, and vice versa, by rotating the waist bag 100 by hand generally about the longitudinal axis (essentially the spine) of the bearer's body. Loosening the belt 180 at the buckle 182 before rotation is recommended so as to reduce friction between the bearer's waist and the belt 180 during the rotation movement. The buckle 182 shown in the drawings is a conventional side release design and comprises two releasably mating components that also permit adjustment of the circumference of the belt 180 when the buckle 182 is closed, so that the bearer can loosen or tighten the belt 180.

The receiver 110 is sized and shaped to be received in the compartment 95 of the lower or inferior part 16 of the backpack 10. The lower part 16 is the part of the backpack 10 that is adjacent the bearer's lumbar region and waist.

The preferred embodiment of the invention shown in the drawings has a receiver 110 of the waist bag 100 that has a generally square cross section. The compartment 95 in the backpack 10 likewise has a generally square cross section. The body contacting wall 120, the non-body contacting wall 130, the top wall 160, and the bottom wall 170 have dimensions that allow the receiver 110 to fit within the compartment 95 snugly enough to place the body contacting wall 120, the non-body contacting wall 130, the top wall 160, and the bottom wall 170 in proximate contact with, respectively, the body contacting wall 20, the non-body contacting wall 30, the middle wall 90, and the bottom wall 70 that form the open-ended compartment 95 of the lower part 16 of the bag portion 12.

The body contacting wall 120, the non-body contacting wall 130, the top wall 160, and the bottom wall 170 of the receiver 110 preferably have horizontal or left-to-right dimensions that generally correspond to those of the body contacting wall 20 and the non-body contacting wall 30 of the backpack 10. Accordingly, the right and left side walls 140 and 150 of the receiver 110 are generally flush with the right and left open sides of the compartment 95 when the receiver 110 is centered in the compartment 95. The receiver 110 will fill up the compartment 95 without appreciably projecting beyond the compartment 95 or the backpack 10. In this configuration the carrying system 1 will appear to be a backpack to all but the more discriminating observer and thus will lack a "gimmicky" look. It also will be noted that in this configuration the receiver 110 will be supported by the backpack 10 with no wobbling or relative movement between the receiver 110 and the backpack 10.

In this configuration, the configuration of the backpack with waist bag carrying system 1 shown in FIGS. 1, 3, and 4, the receiver 110 of the waist bag 100 is centered in the compartment 95. The belt 180 of the waist bag 100 surrounds the waist, generally above the hips of the bearer, and acts as a waist belt for the backpack 10. This configuration of the backpack 10 and the waist bag 100 is similar in appearance and operation to a conventional backpack with waist belt.

In the second configuration of the backpack with integral rotating waist bag 1, shown in FIG. 2, the bearer has pulled the receiver 110 of the waist bag 100 out of the compartment 95, preferably after loosening the belt 180 at the buckle 182 so that the belt 180 will not resist the movement by rubbing against the bearer's waist, and rotated the receiver 110 of the waist bag 100 to the bearer's front or anterior side. It will be noted that the waist bag 100 preferably is worn over the shoulder straps 80 and 82 so that the shoulder straps 80 and 82 do not prevent rotation of the waist bag 100 by interfering with the movement of the receiver 110.

The more detailed structure of the preferred embodiment of a backpack with integral rotating waist bag 1 is shown in the sectional view of FIG. 4. In general, the preferred embodiment of a backpack with integral rotating waist bag 1 shown in the drawings is made of pieces of fabric and straps, buckles, foam padding, and stiffening sheet material sewn to each other in a conventional manner. The body contacting wall 20 is shown to comprise a layer of foam padding 22 overlying the stiff sheeting 24 that goes on to extend through three generally right-angle bends to form a component of the bottom wall 70, a lower or inferior part 32 of the non-body contacting wall 30, and the middle wall 90.

The stiff sheeting 24 (preferably made of high density polyethylene (PE) board sheet material) provides a rigidity that is useful for serving as a frame sheet in the body contacting wall 20. A frame sheet provides some rigidity to the bag portion 12 and helps control the load carried by the backpack 10.

The stiff sheeting 24 also provides some rigidity to the other walls 70, 32, and 90 surrounding the compartment 95. The rigidity should be sufficient to retain the shape of the compartment 95 whether or not the compartment 95 contains the receiver 110. The walls of the compartment 95 might sag if they were not somewhat rigid, especially if the backpack 10 contains a load in the compartment 18, and thus the walls might tend to interfere with both removal of the receiver 110 from the compartment 95 and re-insertion of the receiver 110 into the compartment 95. This is particularly the case when the backpack 10 is being worn on the bearer's back. The bearer will be able to return the receiver 110 to its place in the compartment 95 (or remove it) more readily if the compartment 95 retains its shape for receiving the receiver 110.

The receiver 110 is retained in the compartment 95 partly by friction and is secured in the compartment 95 by the attachment of hook material 230 borne in the waist belt 180 to complementary loop material 200 borne by the backpack 10 inside the compartment 95. The hook material 230 and the loop material 200 is provided as desired to retain the receiver 110 in the compartment 95 so that the receiver 110 does not unintentionally emerge from or shift in the compartment 95. The hook material 230 and the loop material 200 are part of a system or means for detachably securing the receiver 110 in the compartment 95 that is explained in connection with FIGS. 5-12. The securing means may be readily activated or de-activated by the bearer while wearing the backpack 10.

Figure 5:
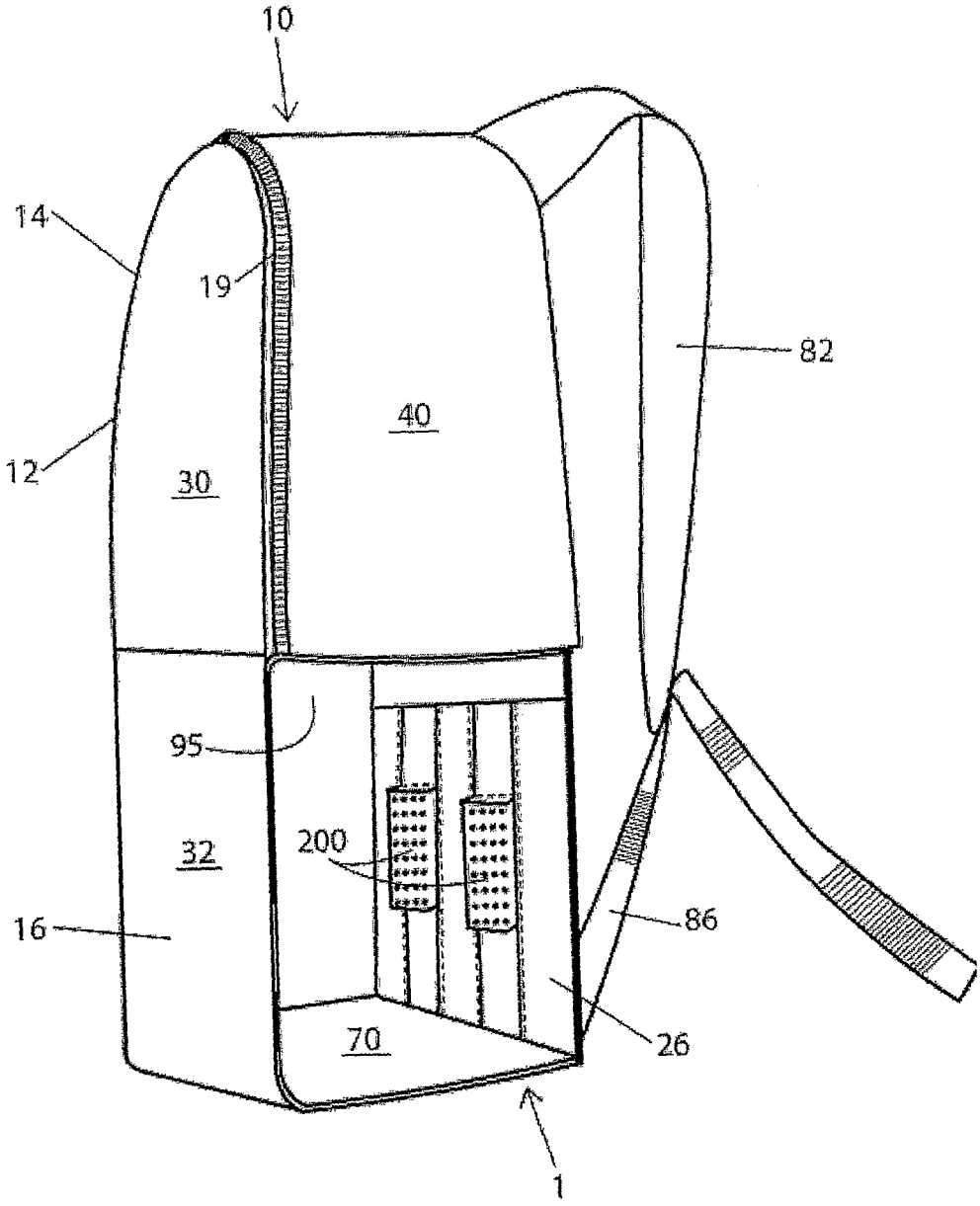
FIG. 5 is perspective view of the backpack element or portion of the preferred embodiment of a backpack with waist bag carrying system of FIG. 1, the waist bag element or portion not being shown so that the compartment in the backpack that receives a receiver of the waist bag may be shown.

FIG. 5 shows the backpack 10 by itself and without the waist bag 100. The wall 26 is a lower part of the body-contacting wall 20 that adjoins and faces the compartment 95 and, in this embodiment, is generally parallel to the lower part 32 of the non-body contacting wall 30. Two loop materials 200 are attached, such as by sewing, to the inside of the wall 26 and facing into the compartment 95. In this embodiment the loop materials 200 are sheet like as in the well-known hook-and-loop material combinations. The loop materials 200 are mounted over semi-cylindrical foam inserts so that they form "bumps." The "bumps" protrude into the compartment 95. The loop materials 200 therefore will protrude into windows formed in the waist belt 180 to engage and fasten to the hook material 230 mounted therein, as will be explained below.

Figure 6:
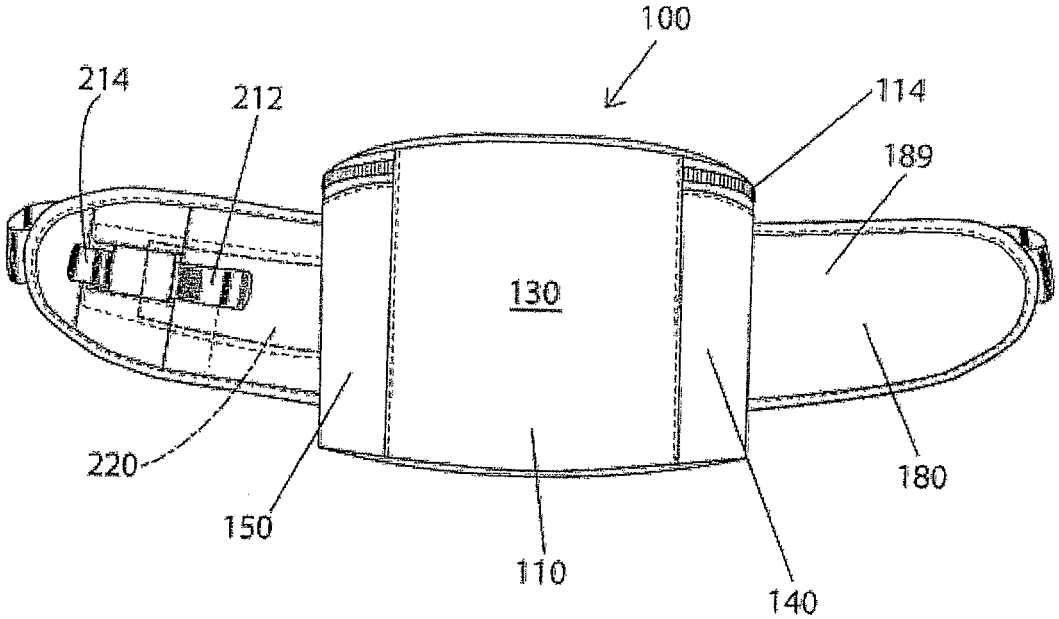
FIG. 6 is a side view of the waist bag element or portion of the preferred embodiment of a backpack with waist bag carrying system of FIG. 1, shown apart from the backpack element or portion.
Figure 7:
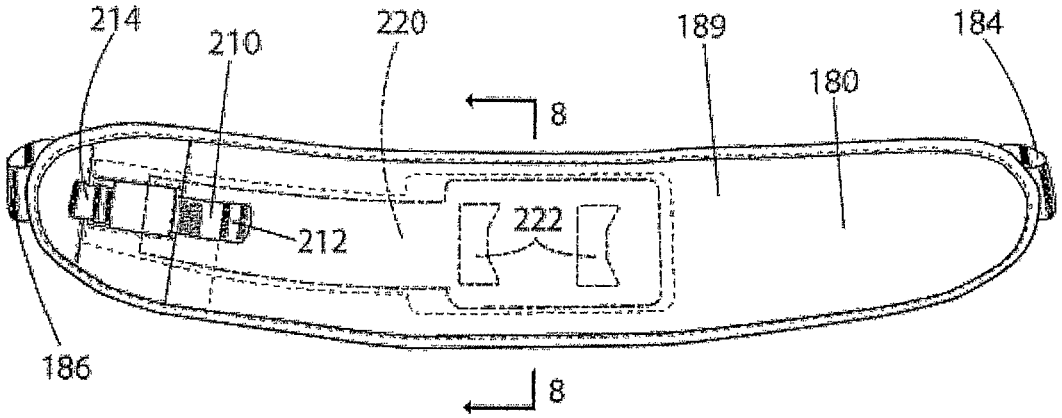
FIG. 7 is a side view of the waist belt element or portion of the waist bag shown in FIG. 6, showing a portion of the system for detachably connecting the waist bag element to the backpack element of the preferred embodiment of a backpack with waist bag carrying system of FIG. 1.
Figure 8:
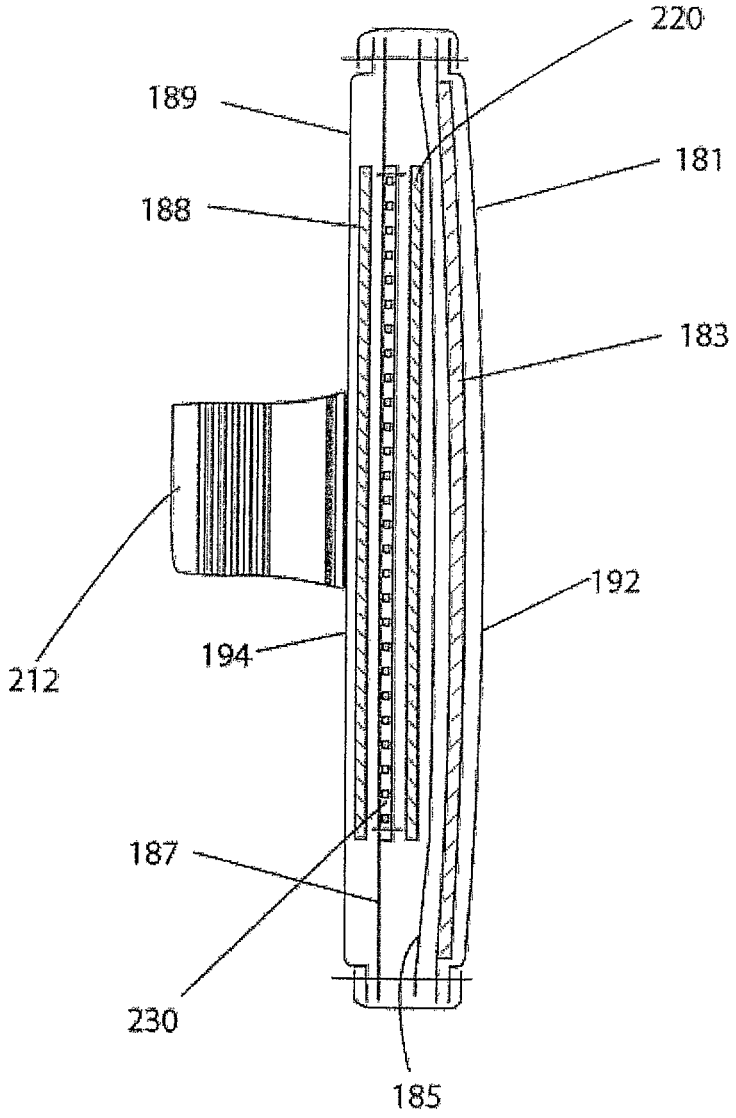
FIG. 8 is a cross-section of the waist belt shown in FIG. 7 taken along plane 8-8 as indicated in FIG. 7.
Figure 9:
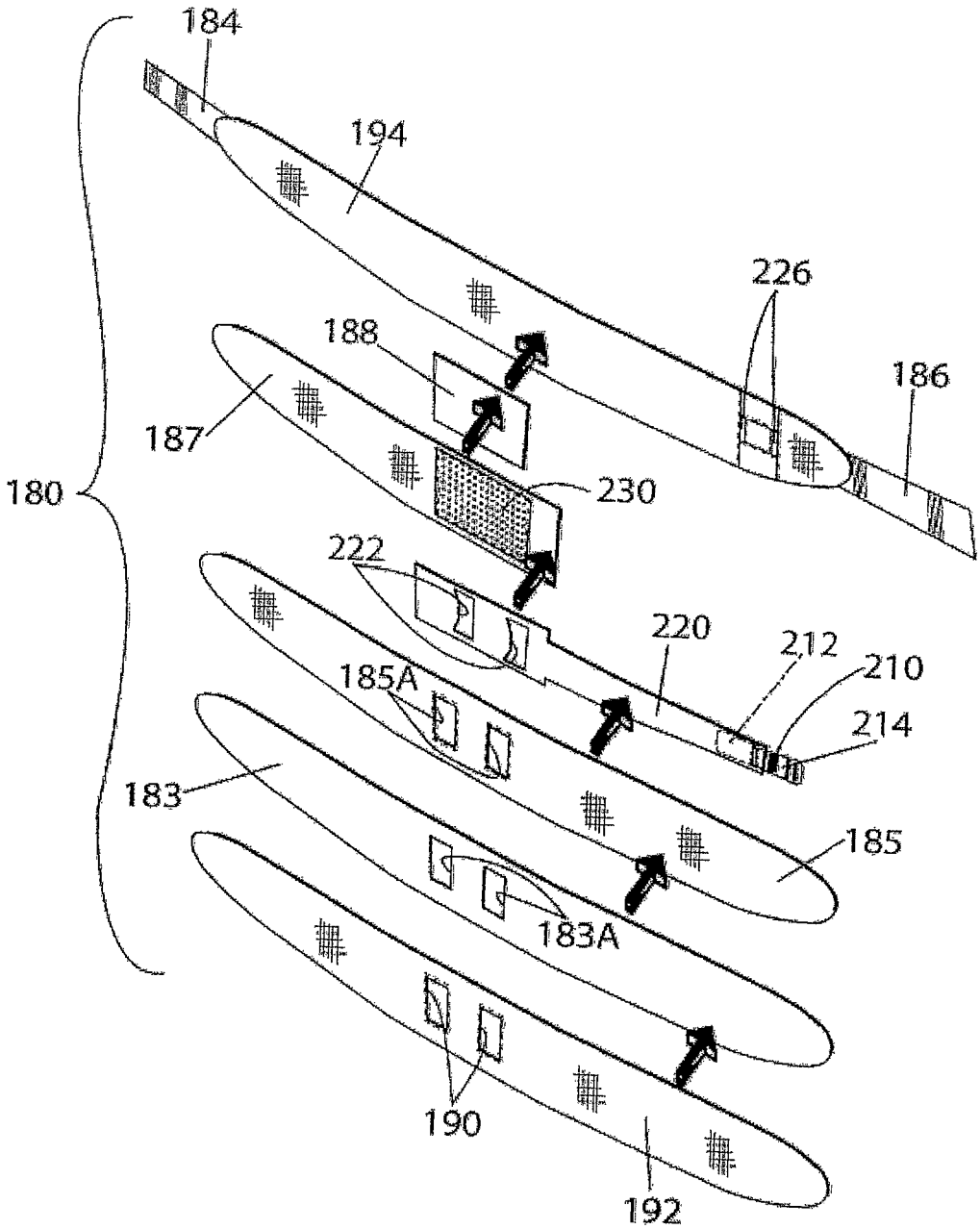
FIG. 9 is an exploded view of the waist belt shown in FIG. 7.

FIG. 6 shows the waist bag 100 with the receiver 110 mounted on the non-body contacting side or sheet 189 of the waist belt 180. FIG. 7 shows the waist belt 180 with the receiver 110 removed. FIG. 8 is a cross-section of the waist belt 180 taken on the plane 8-8 as shown in FIG. 7. FIG. 9 is an exploded view of the waist belt 180 showing its construction. These drawings show how the hook material 230 is mounted in the waist belt 180 and the system used to separate the hook material 230 from the loop materials 200 mounted in the backpack 10.

The cross-section in FIG. 8 and the exploded view in FIG. 9 show the components of the waist belt 180. A body contacting sheet or fabric panel 192 lies over a foam sheet 183. Next is a first inner sheet or fabric panel 185 followed by a sliding flexible but stiff "releaser" panel 220 above a second inner sheet or fabric panel 187 to which is attached the hook material 230. A stiffener sheet 188 is mounted behind the hook material 230 that is mounted on the second inner sheet or fabric panel 187. Next is the non-body contacting sheet or fabric panel 194.

The body contacting sheet or fabric panel 192, the first inner sheet or fabric panel 185, the second inner sheet or fabric panel 187, and the non-body contacting sheet or fabric panel 194 are sewn to each other at their peripheries in manner known to those of ordinary skill in the art to which this invention pertains. The webbings 184 and 186 are also sewn to this assemblage. The webbings 184 and 186 support the buckle 182 (not shown in FIGS. 6-9). Overlapping windows 190, 183A, and 185 are formed in the body contacting sheet or fabric panel 192, the foam sheet 183, and the first inner sheet or fabric panel 185, respectively, to permit access by the loop materials 200 to the hook material 230.

Figure 10:
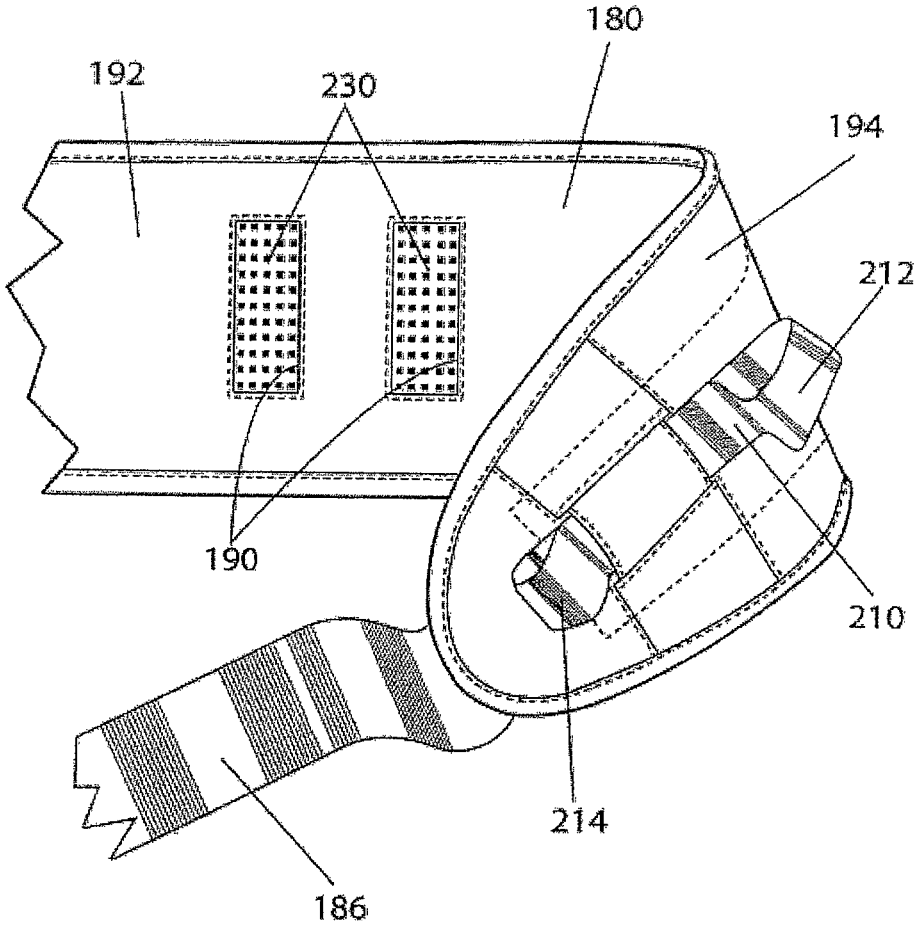
FIG. 10 is a perspective view of a portion of the waist belt shown in FIG. 7 showing a portion of the system for detachably connecting the waist bag element to the backpack element of the preferred embodiment of a backpack with waist bag carrying system of FIG. 1, in which the hook material is fully exposed.
Figure 11:
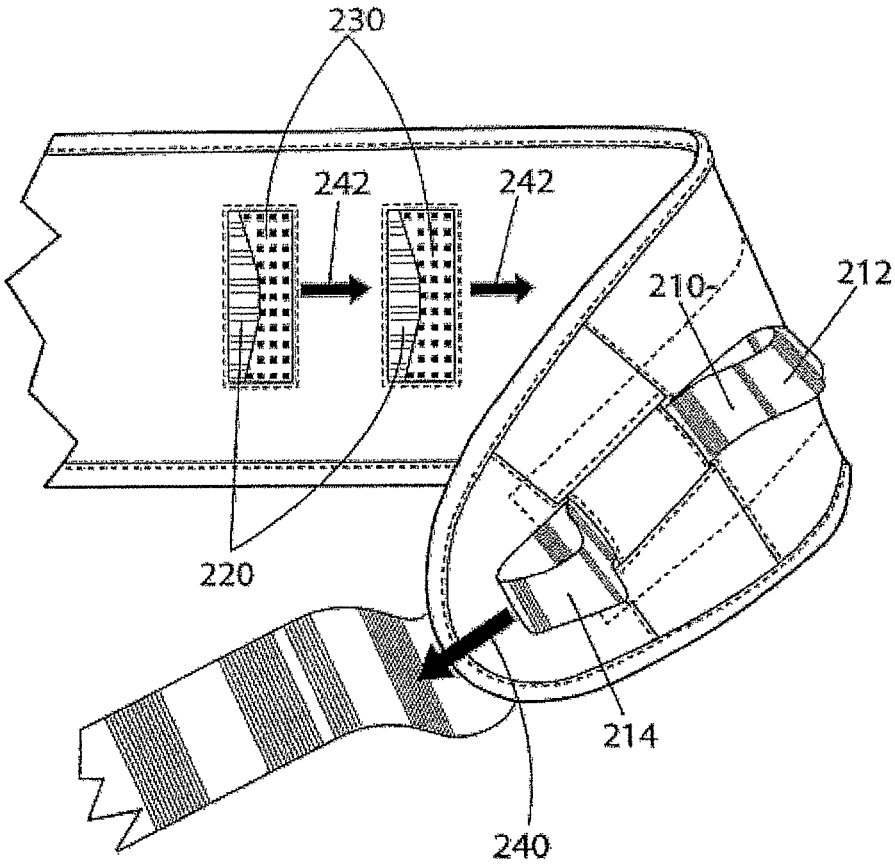
FIG. 11 is a perspective view of a portion of the waist belt shown in FIG. 7 similar to that shown in FIG. 10 in which the hook material is partially exposed.
Figure 12:
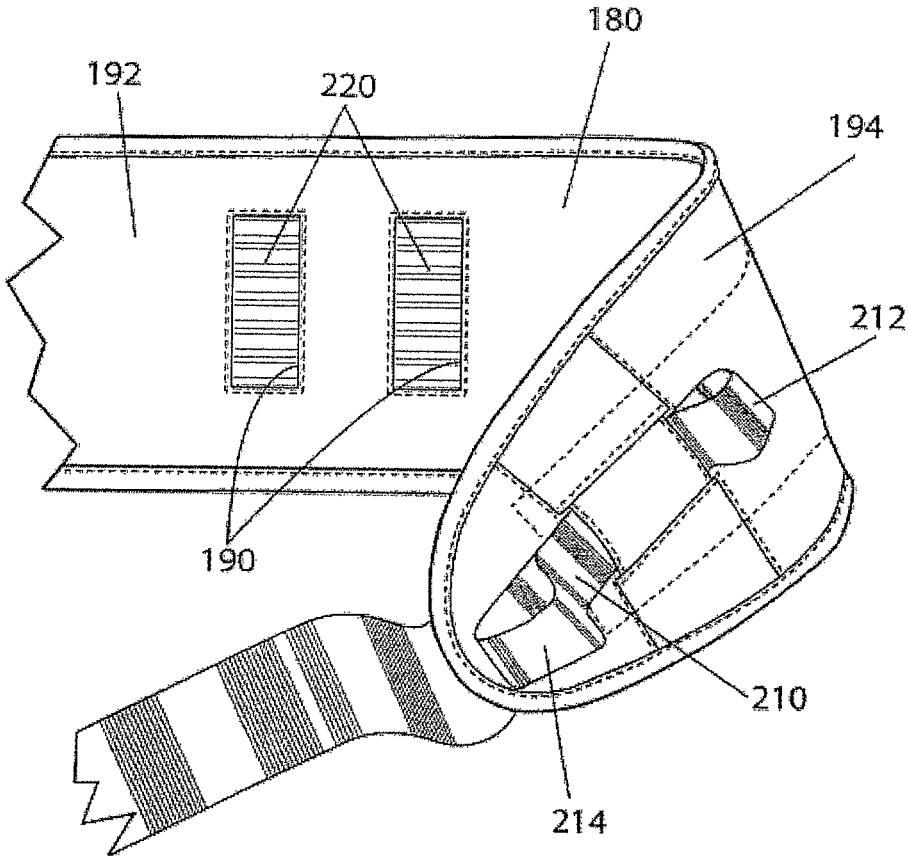
FIG. 12 is a perspective view of a portion of the waist belt shown in FIG. 7 similar to that shown in FIG. 10 in which the hook material is completely covered.

The releaser panel 220 and the stiffener sheet 188 are preferably made of PE board stock. The releaser panel 220 has windows 222 formed in it for permitting access by the loop materials 200 to the hook material 230. The releaser panel 220 is intended to be moved inside the waist belt 180 so as to alternately expose or cover the hook material 230 as illustrated in FIGS. 10-12. A handle 210 preferably made of webbing is attached, such as by sewing, to one end of the releaser panel 220. Loop ends 212 and 214 protrude through slots 226 formed in the non-body contacting sheet or fabric panel 194 so that the bearer may grasp and pull on one or the other of the loop ends 212 and 214 in order to move the releaser panel 220 back and forth as shown in FIGS. 10-12.

The windows 222 formed in the sliding flexible but stiff panel 220 are shaped so that one side is arcuate or shaped like a bow or a broad spearhead in order to better separate the loop materials 200 from the hook material 230 when the releaser panel 220 is advanced across the hook material 230 as shown in FIGS. 10-12. The bearer therefore can easily secure or release the receiver 110 in the compartment 95 by pulling on the loop ends 212 or 214, respectively.

The first preferred embodiment of the invention could be modified in a number of ways. For example, the tunnel-like compartment 95 could be opened up by removing the lower part 32, of the non-body contacting wall 30, leaving the wall 70 as a shelf. Other means for securing the receiver 110 below or in the bag portion 12 of the backpack 10 might be used that will permit the waist bag 100 to rotate below and with respect to the backpack 10 while maintaining an operative connection between the waist bag 100 and the backpack 10 so that the shoulder straps 80 and 82 will be able to provide support to the waist bag 100 and the waist belt 180 will provide support to the backpack 10 at least when the receiver 110 of the waist bag 100 is underneath the bag portion 12 of the backpack 10, while being worn by the bearer. In addition, when in the same configuration, the backpack with rotating waist bag carrying system 1 may be removed from the bearer's body and carried by one hand as a single unit. In other words, the bearer will be able to pick up the backpack with waist bag carrying system 1 by pulling up on one of the shoulder straps 80 or 82 or by a carrying grip strap (not shown) of a well known type attached to the upper part of the bag portion 12 and the backpack with waist bag carrying system I will rise and be carried as a single unit.

A second preferred embodiment of a backpack with waist bag carrying system according to the invention is indicated generally by reference numeral 300 in FIGS. 13-16. This embodiment of a backpack with waist bag carrying system 300 provides a backpack 310 attached to a waist belt 330 that supports two receivers 320A and 320B.

The backpack 310 is of a generally conventional design and has a bag portion 311 attached to shoulder straps 340 and 342. Access to a first compartment in the bag portion 311 of the backpack 310 is by means of a zipper 312, similar to the arrangement described in connection with the backpack 10 of the first embodiment 1.

Figure 13:
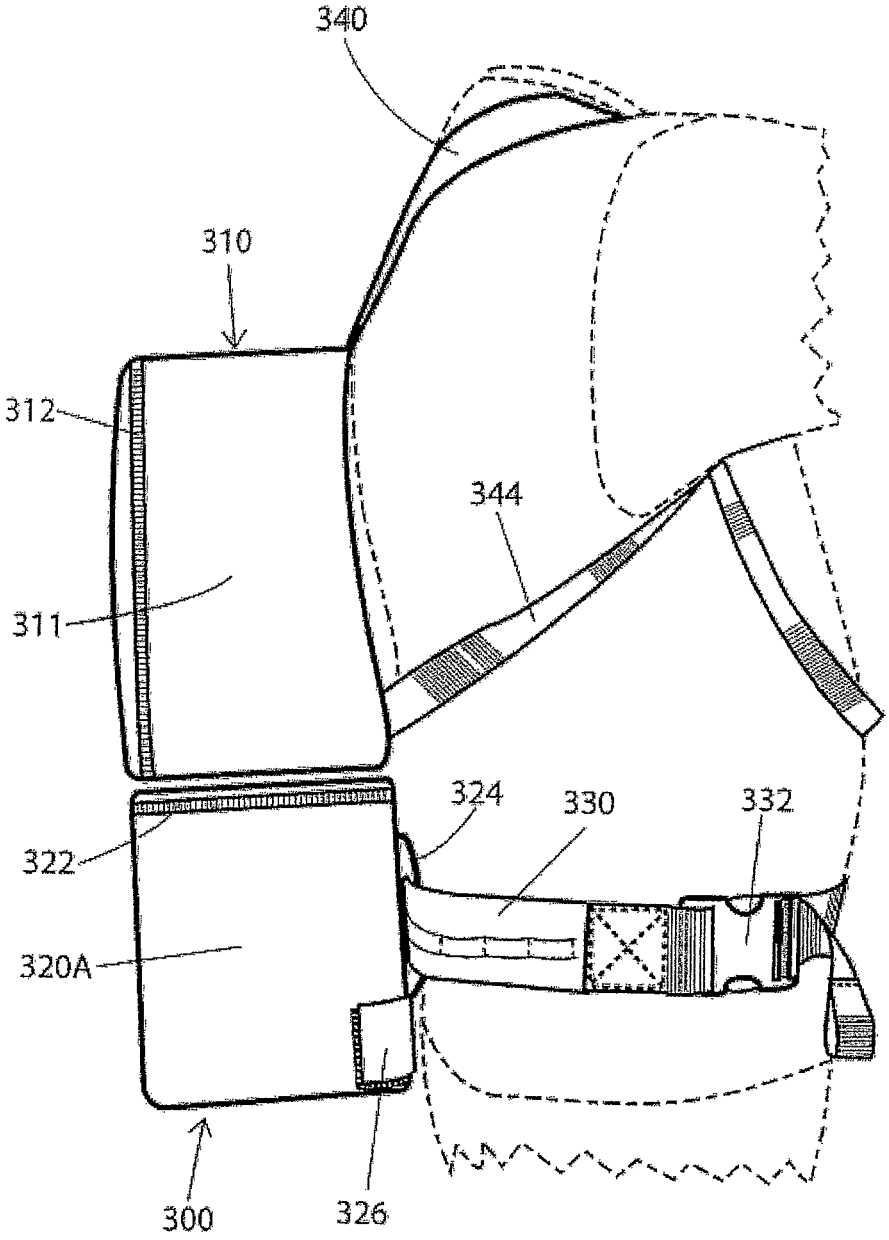
FIG. 13 is a perspective view from the right side of a second preferred embodiment of a backpack with waist bag carrying system according to the invention shown being worn by a human bearer in a first configuration in which the receivers of the waist bag are deployed underneath the backpack.
Figure 14:
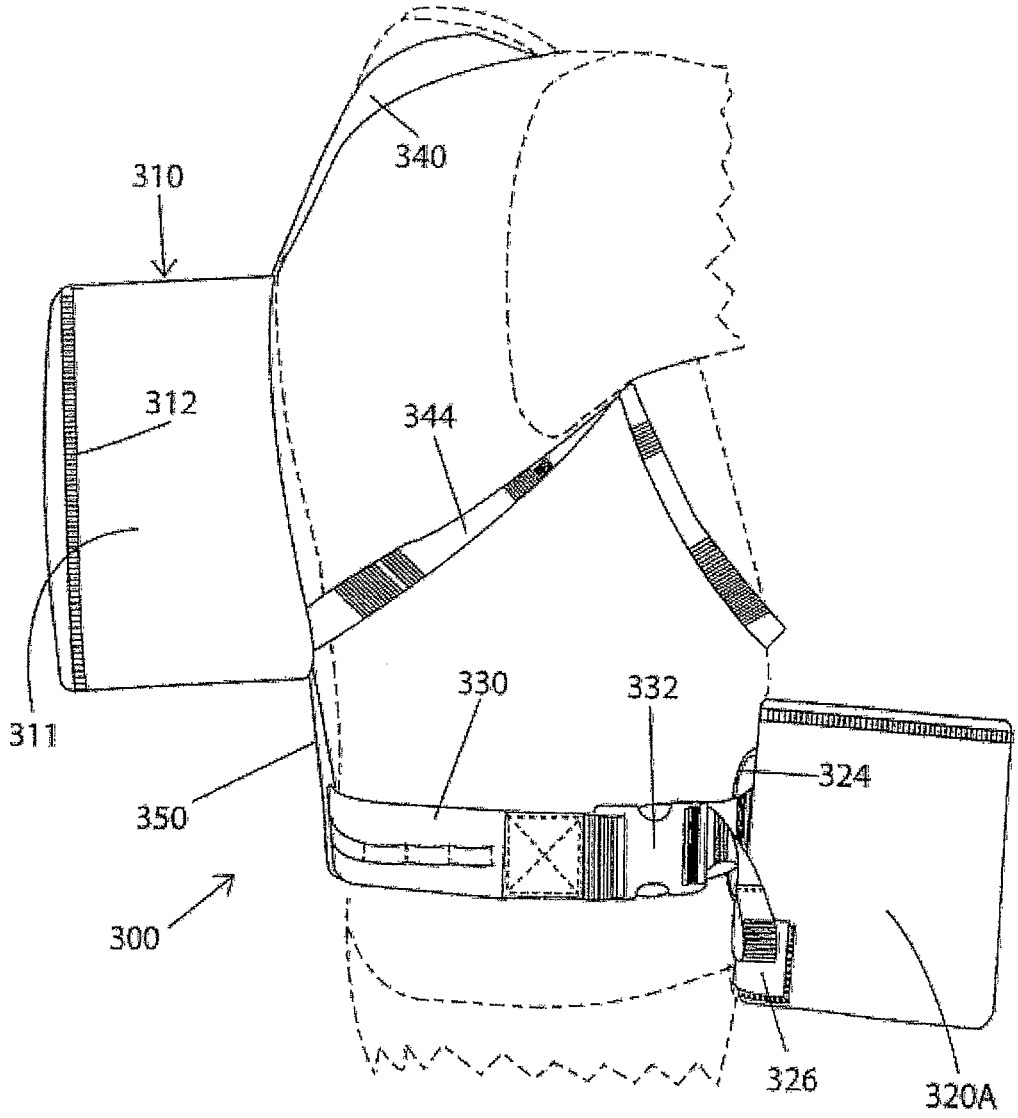
FIG. 14 is a perspective view from the right side of the preferred embodiment of a backpack with waist bag carrying system of FIG. 13 shown being worn by a person in a second configuration in which the receiver of the waist bag is deployed in front of or on the anterior side of the bearer
Figure 15:
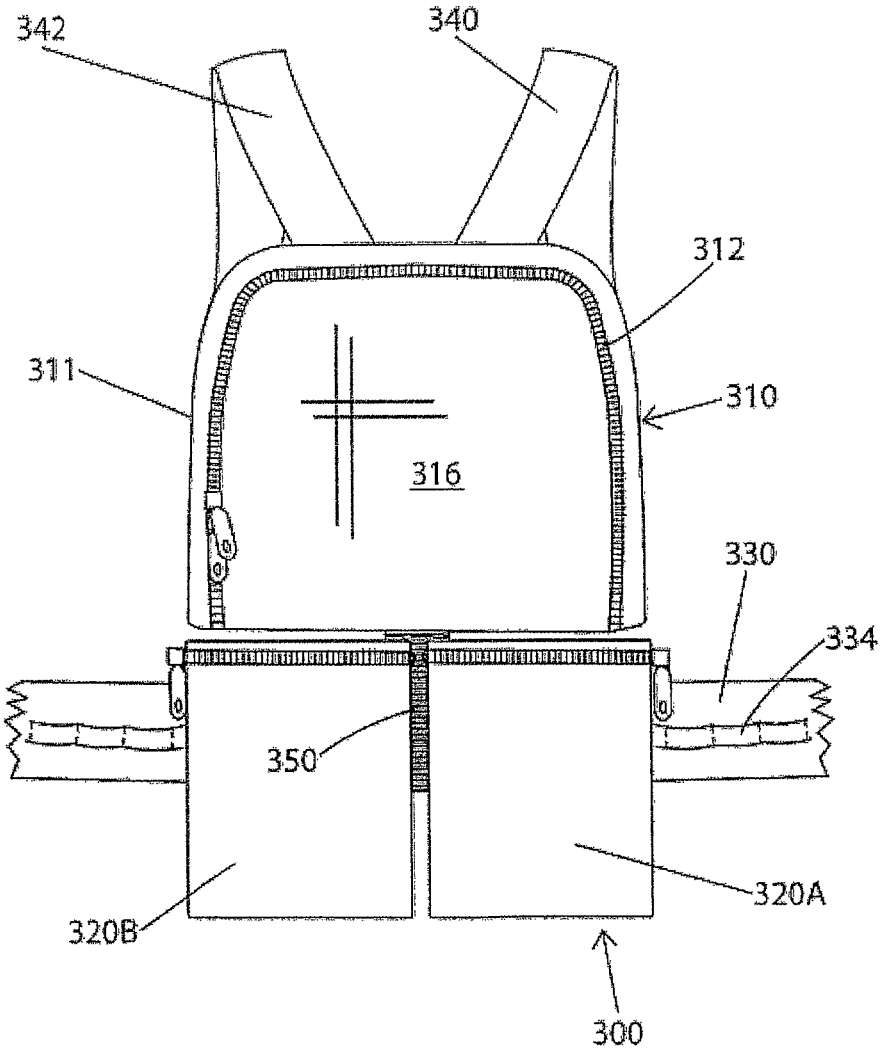
FIG. 15 is a front side view of the preferred embodiment of a backpack with waist bag carrying system of FIG. 13 in the first configuration in which the receivers of the waist bag are deployed underneath the backpack.

The receivers 320A and 320B have the same general construction as the receiver 110 discussed in connection with the first embodiment 1 of a backpack with waist bag carrying system described above. A difference is that the receivers 320A and 320B may be moved with respect to the waist belt 330. The receivers 320A and 320B are each attached on a body contacting side to means for securing them to the waist belt 330 that permit the receivers 320A and 320B to slide or move along the waist belt 330 so that the bearer may move the receivers 320A and 320B from positions that are behind him or her (or adjacent his or her lumbar region) as shown in FIG. 13 (FIGS. 15 and 16 show the same configuration without the bearer being included in the drawings) to positions in front as shown in FIG. 14, and vice-versa.

The means for securing the receivers 320A and 320B to the waist belt 330 shown in the drawings is the system described and claimed in international application PCT/US2005/034036 and published as WO2006/034421, the disclosure of which is incorporated by reference. The receivers 320A and 320B are each attached on a body contacting side to a sleeve 324 that wraps around the waist belt 330 and is secured by hook and loop strips at its end 326 to the body of the receivers 320A or 320B. Other means for securing the receivers 320A and 320B to the waist belt 330 are acceptable if they permit the receivers to move along or slide longitudinally with respect to the waist belt 330.

Figure 16:
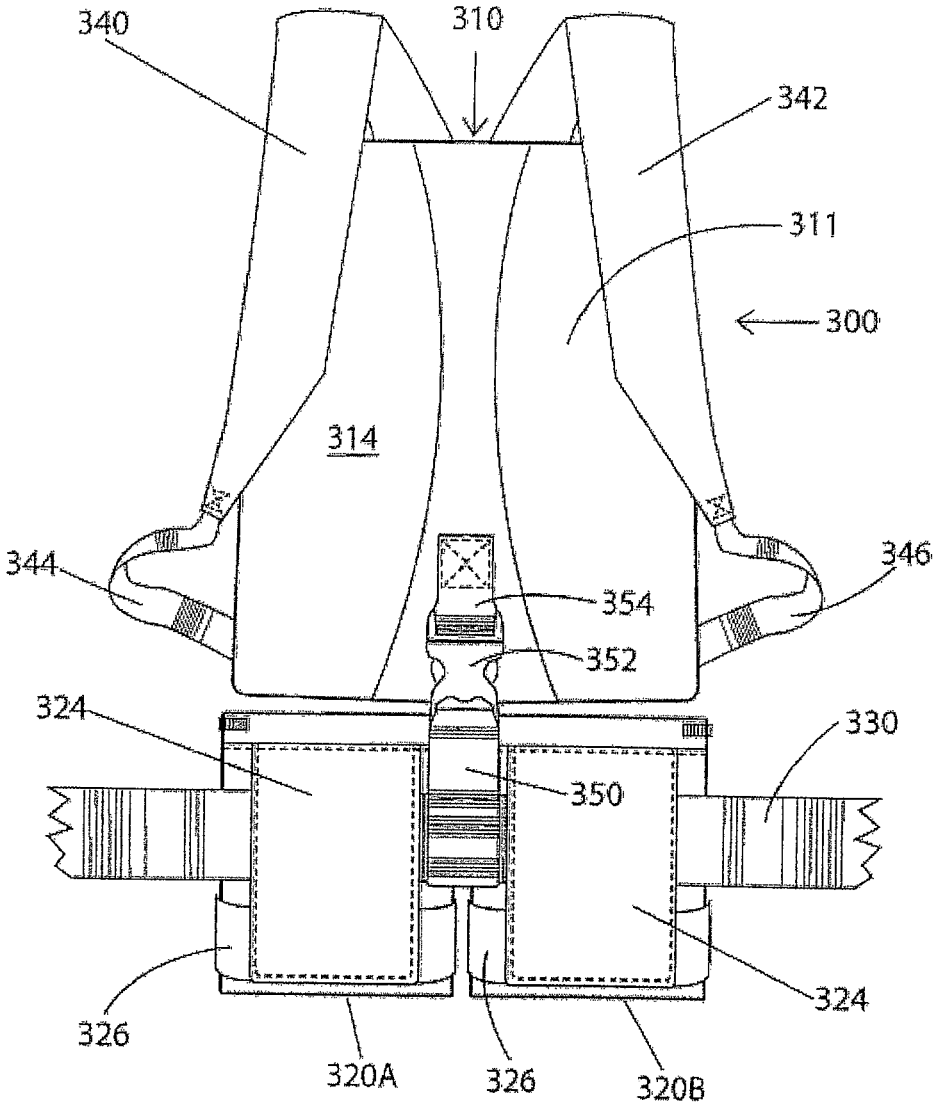
FIG. 16 is a back side view of the preferred embodiment of a backpack with waist bag carrying system of FIG. 13 in the first configuration in which the receivers of the waist bag are deployed underneath the backpack.

As is perhaps best seen in FIG. 16, the waist belt 330 is operatively connected to the backpack 310 by a loop 350 made of webbing. The loop 350 contains a buckle 352 and is attached at an upper end 354 to the body contacting wall 314 of the bag portion 311 of the backpack 310. The waist belt 330 may be released from the backpack 310 if desired by opening the buckle 352. Other means for attaching the waist belt 330 to the backpack 310 may be employed as long as the receivers 320A and 3208 may be accommodated under the bag portion 311 of the backpack 310.

When the receivers 320A and 320B are slid underneath the backpack 310 a conventional backpack configuration is established so that the waist belt 330 supports both the receivers 320A and 320B and the backpack 310 and the shoulder straps 340 and 342 support both the backpack 310 and the receivers 320A and 320B. The receivers 320A and 320B may be deployed to the front side of the bearer and then returned to a position underneath the backpack 310 while the bearer is wearing the backpack 310 and waist belt 330. The bearer does not need to remove either the backpack 310 or waist belt 330 to move the receivers 320 A and 320B to the position he or she prefers.

As noted above in connection with the first embodiment, the second embodiment will maintain an operative connection between the waist belt 330 and the backpack 310 so that the shoulder straps 340 and 342 will be able to provide support to the receivers 320A and 320B and the waist belt 330 will provide support to the backpack 310 at least when the receivers 320A and 320B are underneath the bag portion 311 of the backpack 310, while being worn by the bearer. Once the receivers 320A and 320B are rotated beneath the backpack 310, the waist belt 330 can support the weight of the backpack 310. This means that the bearer can loosen the shoulder straps 340 and 342 so that the weight of the backpack 310 is supported on the waist belt 330 and is therefore supported on the hips of the bearer.

In addition, when in the same configuration, the backpack with waist bag carrying system 300 may be removed from the bearer's body and carried by one hand as a single unit. In other words, the bearer will be able to pick up the backpack with waist bag carrying system 300 by pulling up on one of the shoulder straps 340 and 342 or by a carrying grip strap (not shown) of a well known type attached to the upper part of the bag portion 311 and the backpack with waist bag carrying system 300 will rise and be carried as a single unit.

The user or bearer may wear the backpack 310 and the waist belt 330 (with receivers 320A and 320B mounted thereon) separately, if desired.

Of course, many versions of the second embodiment are possible. For example, only one receiver may be provided. The connection of the backpack 310 to the waist belt 330 could be rigid or even fixed.

While the invention has been described in conjunction with the preferred embodiment, it will be understood that it is not intended to limit the invention to this embodiment or its particular manner of construction, materials or components. On the contrary, the invention is intended to cover alternatives, modifications and equivalents that may be included within the spirit and scope of the invention as defined by the appended claims.

What is claimed is:

1. A backpack with integral waist bag, comprising:

a backpack having shoulder straps and defining a lower compartment in a lower part of the backpack and an upper compartment in the upper part of the backpack, the lower compartment having openings on right and left sides of the lower compartment; and a waist belt attached to a receiver, wherein the waist belt extends through the compartment so as to encircle a bearer's waist when the backpack is worn on the bearer's back, the waist belt comprising a left belt portion that extends from the left side of the receiver and through the left opening on the lower compartment and a right belt portion that extends from the right side of the receiver through the right opening on the lower compartment, the receiver has a cross-sectional size and shape generally matching that of the compartment and releaseably containable therein, and at least one of the openings on the right and left sides of the lower part of the backpack has a size and shape that will permit withdrawal of the receiver from the compartment and entry of the receiver into the compartment, whereby the bearer can rotate the waist belt around the bearer's waist, when the backpack is worn on the bearer's back, between a first position in which the receiver is contained in the compartment and adjacent the bearer's back and a second position in which the receiver is adjacent the front of the bearer, and the bearer may rotate the waist belt around the bearer's waist, when the backpack is worn on the bearer's back, from the second position to the first position.

2. The backpack according to claim 1 wherein the receiver is formed as part of the waist belt.

3. The backpack according to claim 2 wherein the receiver is retained in the compartment at least in part by friction.

4. The backpack and waist bag carrying system according to claim 1 wherein the backpack comprises a body contacting wall, a bottom wall, and a non-body contacting wall, the bottom wall, a lower portion of the body contacting wall, and a lower portion of the non-body contacting wall defining three sides of the compartment in the lower portion of the backpack, the body contacting wall has a top and a bottom, and each of the shoulder straps is attached at opposed ends thereof respectively to the top and to the bottom of the body contacting wall, the end of each shoulder strap attached to the bottom of the body contacting wall being positioned beneath the waist belt whereby the waist belt may be rotated around the body of the bearer.

5. The backpack and waist bag carrying system according to claim 4 wherein the body contacting wall comprises a frame extending between the top and the bottom of the body contacting wall.

6. The backpack and waist bag carrying system according to claim 4 wherein the bottom wall, the non-body contacting wall, and the bag portion comprise frames for providing rigidity to the compartment.

7. A method of carrying articles, comprising:

providing a backpack having shoulder straps and defining an upper compartment in an upper part of the backpack and a lower compartment in a lower part of the backpack, the lower compartment having openings on right and left sides of the lower part of the backpack;

providing a waist belt attached to a receiver, wherein the waist belt extends through the compartment so as to encircle a bearer's waist when the backpack is worn on the bearer's back, the receiver having a cross-sectional size and shape generally matching that of the compartment and releaseably containable therein, and at least one of the openings on the right and left sides of the lower part of the backpack has a size and shape that will permit withdrawal of the receiver from the compartment and entry of the receiver into the compartment;

rotating the waist belt around the bearer's waist, when the backpack is worn on the bearer's back, between a first position in which the receiver is contained in the compartment and adjacent the bearer's back and a second position in which the receiver is adjacent the front of the bearer and is not contained in the compartment.

8. The method according to claim 7 further comprising the step of accessing articles carried in the receiver when the receiver is in the second position.

9. The method according to claim 7, further comprising:

rotating the waist belt around the bearer's waist, when the receiver is in the second position, from the second position to the first position in order to return the receiver to be contained in the compartment.

10. A backpack and waist bag carrying system comprising:

a backpack comprising a bag portion defining a first compartment for receiving articles, the bag portion comprising a body contacting wall, and shoulder straps for supporting the bag portion on a bearer's back, the body contacting wall further comprising a lower portion that extends below the bag portion to a lumbar region of the back of the bearer when the backpack is borne on the back of the bearer;

a waist belt operatively connected to the backpack below the bag portion;

a receiver connected to the waist belt, wherein the bearer may, while wearing the bag portion on the bearer's back, rotate the waist belt around the waist of the bearer in order to shift the receiver from below the bag portion to the front of the bearer and return the receiver from the front of the bearer to below the bag portion, the waist belt maintaining a connection to the backpack below the bag portion during the shift of the receiver from below the bag portion to the front of the bearer and the return to below the bag portion;

the backpack further comprising a bottom wall attached to the lower portion of the body contacting wall for supporting the receiver when the receiver is located below the bag portion; and a non-body contacting wall attached to the bottom wall and extending upwardly to the bag portion, the body contacting wall, the bottom wall, and the bag portion thereby forming a second compartment sized to accommodate the receiver when the receiver is located below the bag portion and having at least one side open to permit entry and exit of the receiver and an opening on a side opposed to the said one side for accommodating the waist belt; and wherein the shoulder straps and the waist belt cooperate with each other in supporting both the bag portion and the receiver when the receiver is in the second compartment and the bearer is wearing the bag portion on the bearer's back, wherein the waist belt has a first belt portion and a second belt portion, the first belt portion extending from one side of the receiver and the second belt portion extending from an opposite side of the receiver, the first belt portion extending from the said one side of the receiver out of the opening on said at least one side, and the second belt portion extending from the opposite side of the receiver out of the opening on the opposite side opposed to said at least one side, such that the first and second belt portions can extend around a user's waist when the receiver is within the second compartment.

11. The backpack and waist bag carrying system according to claim 10 wherein the body contacting wall has a top and a bottom, and each of the shoulder straps is attached at opposed ends thereof respectively to the top and to the bottom of the body contacting wall, the end of each shoulder strap attached to the bottom of the body contacting wall being positioned beneath the waist belt whereby the waist belt may be rotated around the body of the bearer.

12. The backpack and waist bag carrying system according to claim 11 wherein the body contacting wall comprises a frame extending between the top and the bottom of the body-contacting wall.

13. The backpack and waist bag carrying system according to claim 12 wherein the bottom wall, the non-body contacting wall, and the bag portion comprise frames for providing rigidity to the second compartment.

14. The backpack with waist bag carrying system according to claim 10 wherein the receiver is sized so as to not substantially protrude from the open-sided compartment when the receiver is contained in the open-sided compartment and an opening on a side opposed to the said one side for accommodating the waist belt; wherein the waist belt has a first belt portion and a second belt portion, the first belt portion extending from one side of the receive and the second belt portion extending from the opposite side of the receiver, the first belt portion extending from the side of the receiver out of the opening on said at least one side, and the second belt portion extending from the opposite side of the receiver out of the opening on the side opposed to said at least one side, such that the first and second belt portions can extend around a user's waist when the receiver is within the second compartment.

15. A backpack with integral waist bag, comprising:

a backpack having shoulder straps and defining a first compartment in an upper portion of the backpack and a second compartment in a lower portion of the backpack, the second compartment having openings on right and left sides of the lower portion of the backpack; and a waist bag comprising a receiver attached to a waist belt, wherein the waist bag extends through the second compartment so as to encircle a bearer's waist when the backpack is worn on the bearer's back the waist belt comprising a left belt portion that extends from the left side of the receiver and through the left opening on the second compartment and a right belt portion that extends from the right side of the receiver through the right opening on the second compartment, and wherein the receiver has a cross-sectional size and shape generally matching that of the second compartment and releaseably containable therein, whereby the bearer can rotate the waist bag around the bearer's waist, when the backpack is worn on the bearer's back, from a first position in which the receiver is contained in the second compartment and adjacent the bearer's back to a second position in which the receiver is adjacent the front of the bearer.

16. The backpack with integral waist bag according to claim 15, in which the backpack comprises a body contacting wall, a non-body contacting wall, a top wall, a middle wall, and a bottom wall, the body contacting wall and the non-body contacting wall being spaced from and facing each other and joined to the top wall, the middle wall, and the bottom wall whereby the top wall and the bottom wall are spaced from and on either side of the middle wall;

a bag portion comprising right and left side walls attached to the top wall, the middle wall, and an upper portion of the body contacting wall and an upper portion of the non-body contacting wall, to define the first compartment;

the middle wall, the bottom wall, and a lower portion of the body contacting wall and a lower portion of the non-body contacting wall defining the second compartment that is open to the exterior of the backpack on right and left sides of the backpack; and the shoulder straps being provided on the body contacting wall of the backpack and adapted to be hung over the bearer's shoulders whereby the shoulder straps support the backpack on the back of the bearer.

17. The backpack and waist bag carrying system according to claim 16 wherein the body contacting wall has a top and a bottom, and each of the shoulder straps is attached at opposed ends thereof respectively to the top and to the bottom of the body contacting wall, the end of each shoulder strap attached to the bottom of the body contacting wall being positioned beneath the waist belt whereby the waist belt may be rotated around the body of the bearer.

18. The backpack and waist bag carrying system according to claim 17 wherein the body contacting wall comprises a frame extending between the top and the bottom of the body contacting wall.

19. The backpack and waist bag carrying system according to claim 18 wherein the bottom wall, the non-body contacting wall, and the bag portion comprise frames for providing rigidity to the second compartment.

20. The backpack with integral waist bag according to claim 16 in which the lower portion of the body contacting wall, the lower portion of the non-body contacting wall, the middle wall, and the bottom wall are substantially rigid so as to maintain the shape of the second compartment.

21. The backpack with integral waist bag according to claim 15 further comprising hook or loop material located on the lower portion of the body contacting wall for detachable engagement with corresponding loop or hook material located on an inner side of the waist belt opposite the receiver.

22. The backpack with integral waist bag according to claim 21 in which the loop or hook material located on an inner side of the waist belt opposite the receiver is located beneath at least one window in the inner side of the waist belt.

23. A backpack and waist bag carrying system, comprising:

a backpack comprising a bag portion, the bag portion comprising a body contacting wall, a non-body contacting wall, a middle wall, and a bottom wall, the body contacting wall and the non-body contacting wall being spaced from and facing each other and joined to the middle wall and the bottom wall by right and left side walls, whereby the portion of the backpack above the middle wall comprises an upper portion of the backpack and a first compartment is defined in the upper portion of the backpack, and the portion of the backpack below the middle wall comprises a lower portion of the backpack, the backpack being sized so that lower portion of the backpack is adjacent to the lumbar portion of the back of a human bearer when the backpack is worn on the back of the human bearer, and a second compartment is defined in the lower portion of the backpack;

the body contacting wall having a top and a bottom and comprising a frame extending between the top and the bottom of the body contacting wall;

the bottom wall and a lower portion of the non-body contacting wall each comprising a frame for providing rigidity to retain the shape of the second compartment;

the backpack having shoulder straps, each shoulder strap being attached to the backpack at the top and the bottom of the body contacting wall and so disposed that the shoulder straps will each pass over one of the shoulders of the bearer when the backpack is worn on the back of the bearer, whereby some or all of the weight of the backpack may supported from the shoulders of the bearer;

the second compartment having openings on right and left sides of the lower portion of the backpack;

a waist bag comprising a receiver attached to a waist belt, the receiver defining an internal compartment, wherein the waist bag extends through the second compartment and through the openings on the right and left sides of the lower portion of the backpack so as to encircle the bearer's waist when the backpack is worn on the bearer's back the waist belt comprising a left belt portion that extends from the left side of the receiver and through the left opening on the second compartment and a right belt portion that extends from the right side of the receiver through the right opening on the second compartment;

at least one of the openings on the right and left sides of the lower portion of the backpack being sized and shaped to permit the ingress and egress of the receiver attached to the waist belt;

wherein the receiver has a cross-sectional size and shape generally matching that of the second compartment and the receiver is releaseably containable in the second compartment, whereby the bearer can rotate the waist bag around the bearer's waist, when the backpack is worn on the bearer's back and without having to remove the backpack from the bearer's back, from a first position in which the receiver is contained in the second compartment and adjacent the lumbar region of the bearer's back, through the at least one of the openings on the right and left sides of the lower portion of the backpack sized and shaped to permit the ingress and egress of the receiver, to a second position in which the receiver is adjacent the front of the bearer, in which the bearer may readily see and access the contents of the internal compartment of the receiver, and then back to the first position in which the receiver is in the second compartment;

the end of each shoulder strap attached to the bottom of the body contacting wall being positioned beneath the waist belt whereby the waist belt may be rotated around the body of the bearer.

24. The backpack and waist bag carrying system according to claim 23 wherein the receiver has a body contacting wall and a non-body contacting wall, the body contacting wall and the non-body contacting wall being generally opposed to each other and joined by right and left side walls, a top wall, and a bottom wall that together define the internal compartment, the internal compartment being accessed via an opening at the juncture of the top wall, the body contacting wall, the right side wall, and the left side wall, and the top wall is secured to at least a portion of the non-body contacting wall, the opening being reversibly secured by a zipper, and when the opening is not secured by the zipper the top wall may be rotated above the non-body contacting wall and away from the front of the body of the bearer so the bearer may see and access the contents of the internal compartment.

* * * * *